US005092087A

United States Patent [19]

Kane et al.

[11] Patent Number: 5,092,087

[45] Date of Patent: Mar. 3, 1992

[54] SKYLIGHT FRAMEWORK

[75] Inventors: Charles E. Kane, Greenfield; Michael P. Ryer, Port Washington; Michael H. Schmidt, Colgate, all of Wis.

[73] Assignee: SuperSky, Mequon, Wis.

[21] Appl. No.: 565,980

[22] Filed: Aug. 13, 1990

[51] Int. Cl.[5] ..... E04B 7/18; E04D 13/03

[52] U.S. Cl. ..... 52/15; 52/14; 52/198; 52/200; 52/208; 52/209

[58] Field of Search ..... 52/198, 199, 200, 208-210, 52/235, 92, 93, 14, 15

[56] References Cited

U.S. PATENT DOCUMENTS

| | | | |
|---|---|---|---|
| 2,874,653 | 2/1959 | Ratner | 52/14 |
| 3,844,087 | 10/1974 | Schultz et al. | 52/200 |
| 4,455,798 | 6/1984 | Tsakiris | 52/200 |
| 4,683,693 | 8/1987 | Rockar et al. | 52/198 |
| 4,850,167 | 7/1989 | Beard et al. | 52/14 X |
| 4,918,882 | 4/1990 | Funk | 52/200 X |

OTHER PUBLICATIONS

Pages 20 and 23, Super Sky Products, Inc. brochure, 1986.

*Primary Examiner*—John E. Murtagh
*Assistant Examiner*—Deborah McGann Ripley
*Attorney, Agent, or Firm*—Quarles & Brady

[57] ABSTRACT

A framework for supporting the glass panels of a skylight is formed of spacedrafters inter-connected by cross bars. The rafters have upstanding side flanges provided with pairs of transverse slots. The ends of the cross bars have pairs of outwardly extending headed members adapted to be engaged in the slots to locate the cross bars. The rafters have a ledge below each side flange upon which the bottom of a cross bar can rest. The cross bars are locked in place on the rafters by extending a pin from the cross bar to engage in a recess on the underside of the side flange. The recesses and ledges in the rafters form parts of gutters. A channel-like gutter is also provided on the sides of the cross bars so that condensation from the cross bars will flow into the channel gutters and then to the gutters in the rafters where it can flow to a collection point.

13 Claims, 2 Drawing Sheets

FIG. 3
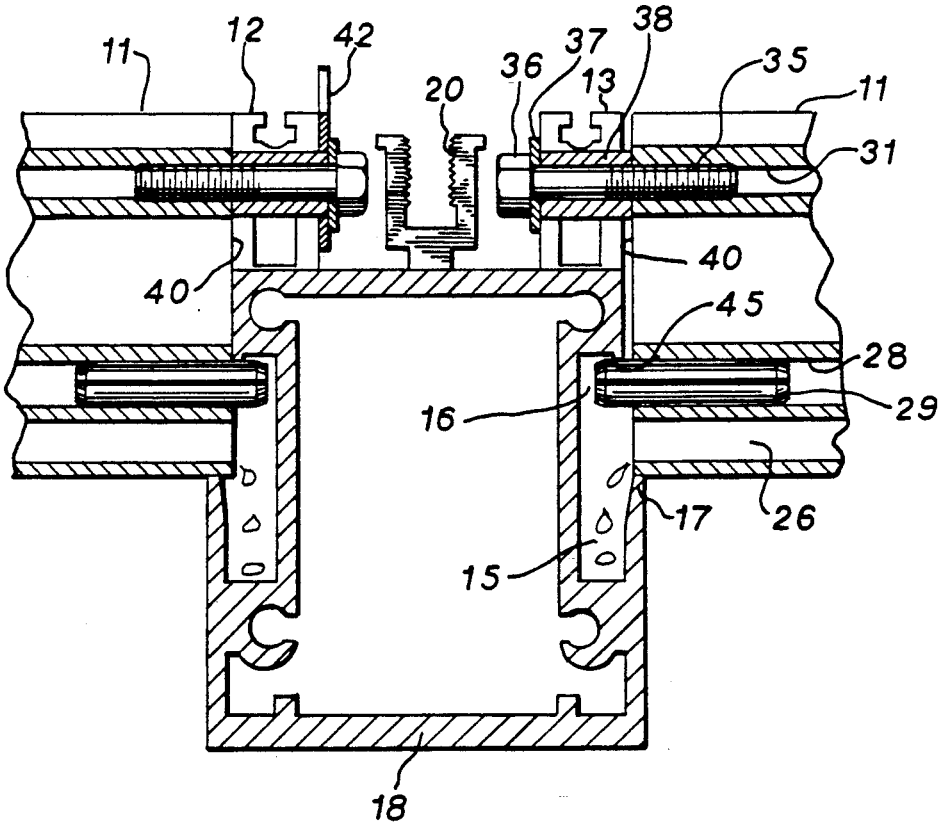
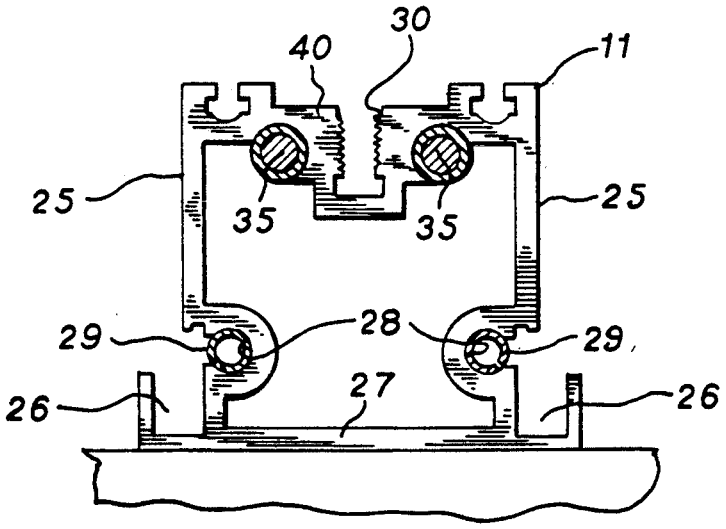
FIG. 4

SKYLIGHT FRAMEWORK

BACKGROUND OF THE INVENTION

This invention relates to a structural framework, and particularly to a framework of interconnected rafters and cross bars to support the glass panels of a skylight.

Frameworks for the glass panels that form a skylight are typically built up from extruded aluminum rafters and cross bars that are joined together in a variety of ways using threaded fasteners, clips, or the like. The ideal skylight framework will allow for ease of assembly, preferably by one person and without the need for special tools. It is also desirable that the framework be capable of being assembled in any sequence and either from the inside or outside of the resulting structure. The ideal skylight framework will also have provision to collect and transport away from the framework condensation that is likely to collect on the surfaces of the aluminum structural members. Finally, to the extent possible, the framework should have no exposed fasteners.

The skylight framework of this invention meets the foregoing criteria.

SUMMARY OF THE INVENTION

In accordance with the invention, a framework is formed that includes a rafter and a cross bar. The rafter has a projecting flange with a planar outer surface and a transverse slot through the flange. The cross bar has a planar end face adapted to oppose the outer surface of the flange of the rafter. The cross bar also has a headed member projecting outwardly from the end face of the cross bar to be received in the slot in the flange of the rafter so that the flange is disposed between the end face of the cross bar and the head of the member.

A complete framework is formed of a plurality of rafters spaced from each other and with a plurality of cross bars spanning the distance between the rafters. To that end, each rafter preferably has a pair of side flanges with slots and each of the cross bars has a headed member projecting from each end.

Preferably, there is a pair of headed members at each end face of a cross bar and a corresponding pair of transverse slots in each side flange. The headed members may be formed of headed bolts that are threaded into the end face of the cross bars, with a washer against the head and a cylindrical sleeve surrounding the bolt between the washer and end face. For purposes of accommodating expansion and contraction, a clearance is provided between the end face of the cross bar and the outer surface of the rafter flange and the clearance is accomplished by selecting suitable lengths for the sleeve. However, the clearance at one end of the cross bar is preferably taken up by a flat shim disposed between the flange and the washer.

Further in accordance with the invention, the rafters are provided with ledges that extend outwardly of the outer surface of the side flanges and the bottoms of the cross bars rest against the ledges when the headed members are in place in the slots of the rafter. The cross bars can be locked in place on the rafter by means of a pin extending from the end face of the cross bar and engageable with a recess in the side of the rafter between the ledge and the side flange.

The ledge and recess can be portions of a gutter formed in the side of the rafters. Similar gutters in the form of open channels can be provided along the lower side edges of the cross bars to collect condensation from the cross bars. When the cross bars are in place on the rafters, the channels will open into the gutters in the rafters so that the condensation can be carried by the gutters away from the framework structure.

Although the framework is particularly useful for supporting glass panels comprising a skylight, the elements can be used for any type of structural framework.

It is a principal object of this invention to provide a structural framework that is easy to assemble.

It is a further object of the invention to provide a structural framework that lacks exposed fasteners.

It is another object of the invention to provide a structural framework having integral channels and gutters that cooperate to collect and carry away condensation that may collect on the framework.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 3 is a view in vertical section through a rafter and a pair of cross bars and taken in the plane of the line 3—3 of FIG. 2; and FIG. 4 is a view in vertical section through a cross bar and taken in the plane of the line 4—4 of FIG. 2.

DETAILED DESCRIPTION OF THE PREFERRED EMBODIMENT

Figure 1:
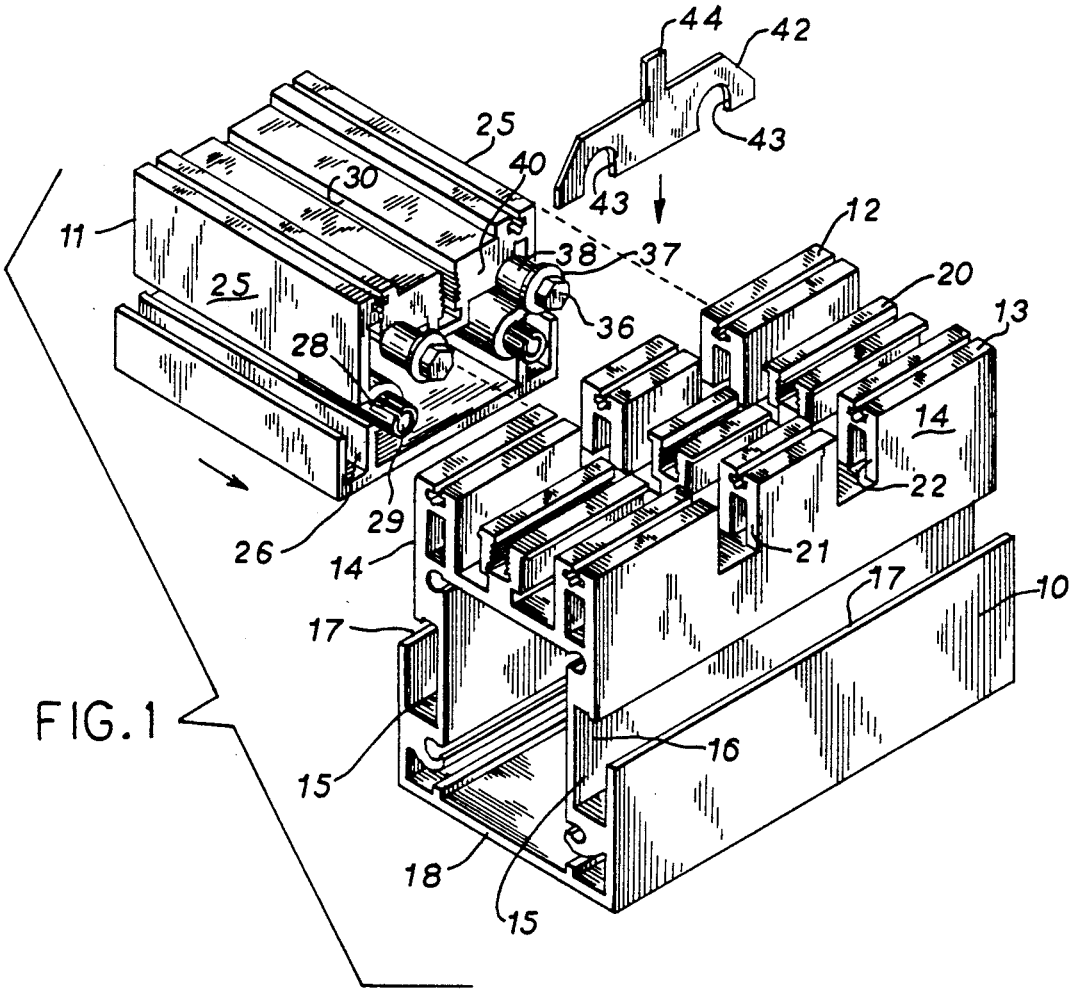
FIG. 1 is a view in perspective of a section of rafter and section of cross bar used to form the framework of this invention.
Figure 2:
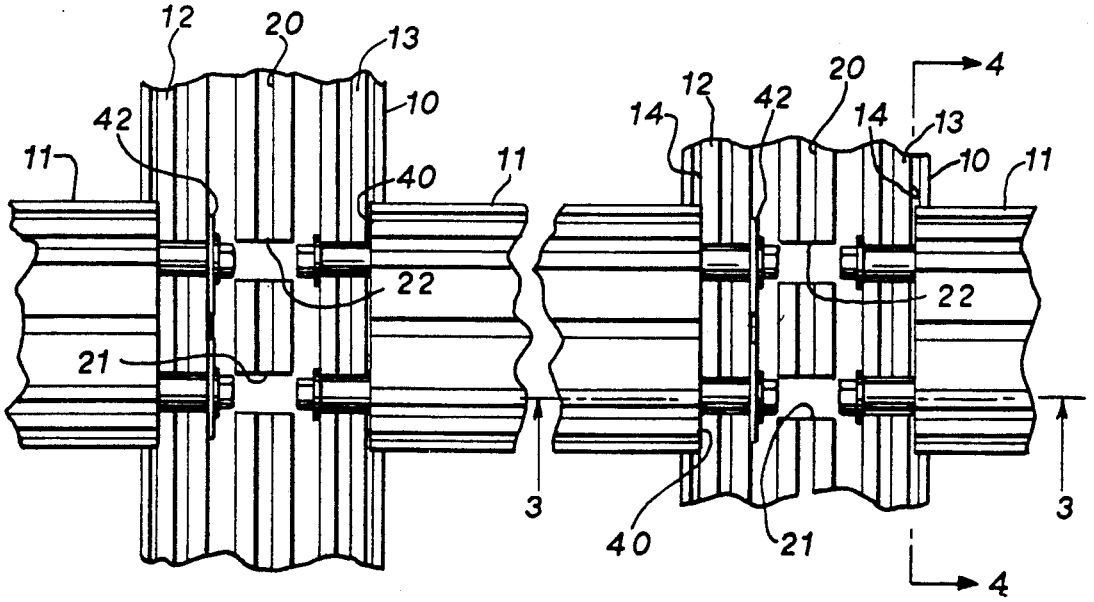
FIG. 2 is a top plan view of a pair of rafters and several cross bars each shown foreshortened for purposes of illustration.

Referring to the drawings, the skylight framework is made up of a series of rafters 10 and cross bars 11, both of which are preferably formed as extruded aluminum shapes. The rafter 10 is formed with a box-like cross-section and a pair of side flanges 12 and 13 each having a planar outer surface 14. The flanges 12 and 13 define the top edges and a portion of the sides of the rafter 10. A gutter structure 15 is formed beneath each of the side flanges 12 and 13 in the sides of the rafter 10. Each gutter 15 includes a recess 16 that extends inwardly from the outer surface 14 of a side flange, and an upright ledge 17 which together with the recess 16 defines a channel. The ledge 17 extends in a plane which is disposed laterally outside of the plane of the outer surface 14 of a flange.

The rafter 10 also includes an upright central mounting portion 20 that extends midway between the side flanges 12 and 13 and a bottom wall 18. Pairs of transverse slots 21 and 22 extend through the side flanges 12 and 13 and the mounting portion 20 from outer surface to outer surface of the two flanges.

The cross bars 11 are each formed with a box-like cross-section having lateral side faces 25 that are planar and upright. As shown particularly in FIG. 4, side channels 26 are formed in the cross bars 11 beneath the side faces 25 and the channels form gutters which is generally centered in the plane of the side faces 25. A bottom wall 27 spans the sides of the cross bar 11 and defines a planar bottom surface with the channels 26. A pair of circular cylindrical recesses 28 are formed in each side of the cross bar 11 and are adapted to slidably mount pins 29 which may take the form of roll pins.

The top of each cross bar 11 has a longitudinally extending mounting recess 30 disposed midway between the side faces 25. Another pair of circular cylindrical recesses 31 are formed on either side of the mounting recess 30. The cylindrical recesses 31 receive the threaded ends of self-taping bolts 35. The bolts 35 have a hexagonal head 36 and mount a washer 37 against the head 36 and a cylindrical sleeve 38 that extends between the washer and an end face 40 of the cross bar. The end face 40 lies in a single plane which is typically perpendicular to the longitudinal axis of the cross bar.

The cross bars are assembled to the rafters by first assembling the headed bolts 35 with the washers 37 and sleeves 38 to a cross bar 11 to form a headed member. The cross bar 11 can then be slipped onto a side flange of a rafter 10 by engaging the headed members in the slots 21 and 22 in the side flanges. The sleeves 38 are sized to be equal in diameter to the width of the slots and the length of the sleeves 38 are such that they slightly exceed the width of a side flange 12 or 13. As a result, when a cross bar 11 is in place on a flange 12 or 13, there is a slight clearance (as seen most clearly in FIG. 3) between an end face 40 of the cross bar 11 and the outer surface 14 of the flange. The clearance may be taken up by a flat shim 42 which has a pair of semi-circular cut-outs 43 to be received over the sleeves 38 and to be positioned between a washer 37 and the side flange. The shim 42 has a central tab 44 for grasping the shim. The clearance would typically be taken up only at one end of the cross bar so that a space is allowed at the other end for expansion and contraction due to temperature changes.

When the cross bars with the headed assemblies are in place on the side flanges, the bottom of the cross bar will rest upon the upper edge of the ledge 17 of an adjacent gutter 15. The cross bars may then be locked in place by extending the pins 29 axially into the recesses 16 so that they engage a lip 45 at the bottom of an outer surface 14 of a respective side flange. When the cross bars 11 are in place on the rafters 10, the open ends of the channels 26 in the cross bars communicate with the gutters 15 in the rafters so that condensation collecting on the sides of the cross bars will collect in the channels 26 of the cross bars and join condensation collected from the sides of the rafter. The condensation travels down the channels 15 to a collection point.

Although the rafters 10 are shown parallel with each other, they may converge in particular installations. Then, the end faces 40 of the cross bars 11 would be formed at the appropriate angle to the longitudinal axis of the cross bar and the slots in the side flanges 12 and 13 would be formed at a complementary angle to the longitudinal axis of the rafter.

The rafters and cross bars may be used to form a ceiling framework or a side wall framework, or any arrangement between those extremes.

The cross bars can be assembled to the rafter by a single person because they fit together without the need for manipulating fasteners. The assembly can take place from the inside or outside of the framework.

The glass panels forming the skylight would be attached to the framework in a standard manner. The edges of the glass panels rest upon the top surfaces of the side flanges 12 and 13 of the rafter 10 and on the tops of the cross bars 11. Clips or other means are used to span the edges of adjacent panels and the clips are fastened to the mounting portions 20 of the rafters and the mounting recesses 30 of the cross bars. When the glass panels are in place, the headed members used to form the framework are covered by the panels.

We claim:

1. A structural framework, including:

a rafter having a projecting flange with a planar outer surface and a pair of spaced slots through the flange and transverse to the outer surface, the slots being open to the top of the flange;

a cross bar having a planar end face adapted to oppose the outer surface of the flange of the rafter; and a pair of spaced headed members projecting outwardly from the end face of the cross bar, each of the members being adapted to be received in a respective slot in the flange with the flange disposed between the end face of the cross bar and the heads of the members.

2. A framework in accordance with claim 1 together with a flat shim adapted to be positioned between the heads of the two members and the flange to cause the end face of the cross bar to abut against the outer surface of the flange.

3. A framework in accordance with claim 1 wherein the rafter has a ledge that extends outwardly beyond the plane of the outer surface of the flange, and the cross bar rests upon the ledge when the headed members are received in the slots in the flange.

4. A framework in accordance with claim 3 wherein the rafter has a recess located between the outer surface of the flange and the ledge, together with a pin received in the cross bar and movable into the recess to lock the cross bar against withdrawal from the rafter.

5. A framework in accordance with claim 1 wherein the headed members each comprise a headed fastener received in the cross bar, a washer disposed against the head of the fastener, and a cylindrical sleeve surrounding the fastener between the washer and the end face of the cross bar.

6. A skylight framework, comprising:

a plurality of spaced rafters each having a pair of spaced side flanges with each flange having a planar outer surface and transverse slots in the flange, the slots being open to the top of the flange;

a plurality of cross bars spanning the distance between adjacent rafters and each having planar faces at its opposite ends; and a headed member projecting outwardly from each end face of the cross bars, the member of each cross bar being adapted to be received in the slot in the flange of a rafter with the flange being disposed between an end face of the cross bar and the head of the member.

7. A framework in accordance with claim 6 wherein the space between the head of a headed member and the end face of a cross bar is greater than the thickness of a side flange, together with a flat shim adapted to be positioned between the headed end of a member at one end of a cross bar and the respective side flange to cause such end face of the cross bar to abut against the outer surface of the flange while leaving a clearance between the other end face of the cross bar and the side flange of the other rafter to which the cross bar is connected.

8. A skylight framework in accordance with claim 6 wherein each rafter has a ledge that extends outwardly beyond the plane of the outer surface of each flange, and wherein the cross bars rest upon the ledges when the headed members are received in the slots in the flanges.

9. A framework in accordance with claim 8 wherein each rafter has a recess located between the outer surface of each side flange and a respective ledge, together with pins received in the cross bars that are movable into the recesses to lock the cross bars against withdrawal from the rafters.

10. A framework in accordance with claim 6 wherein there are pairs of transverse slots in each flange of the rafters and pairs of headed members projecting from each end face of the cross bars.

11. A framework in accordance with claim 10 wherein the headed members each comprise a headed bolt threaded into the respective cross bar, a washer disposed against the head of the bolt, and a cylindrical sleeve extending between the washer and the end face of the cross bar.

12. A structural framework, comprising:

a rafter formed with spaced upright side flanges each having a planar outer surface and a transverse slot in the flange, the slot being open to the top of the flange;

the rafter also being formed with a gutter disposed beneath each side flange, each gutter being recessed inwardly of the outer surface of the flange and also having an upstanding lip disposed outwardly of the outer surface of the flange;

cross bars each having spaced longitudinal upright sides terminating in a planar end face adapted to oppose the outer surface of a flange of the rafter, and a bottom adapted to rest upon the lip of the gutter beneath the flange;

said cross bars each also having open channels formed on either side of the bottom beneath the sides of the cross bar and which open into the gutter upon which the cross bar rests; and a headed member projecting outwardly from each end face of the cross bars and adapted to be received in the slot in a flange of the rafter with the flange disposed between the end face and the head of the member.

13. A framework in accordance with claim 12, together with a pin received in the end of each cross bar and movable into the recess of the gutter to engage the underside of the side flange to lock the cross bar against withdrawal from the rafter.

* * * * *